US008961211B2

(12) United States Patent
Zhu et al.

(10) Patent No.: US 8,961,211 B2
(45) Date of Patent: Feb. 24, 2015

(54) CARD EDGE CONNECTOR WITH FLOATING METAL MEMBER

(71) Applicant: Hon Hai Precision Industry Co., Ltd., New Taipei (TW)

(72) Inventors: Jian-Kuang Zhu, Kunshan (CN); Da-Lei Chen, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 115 days.

(21) Appl. No.: 13/869,007

(22) Filed: Apr. 23, 2013

(65) Prior Publication Data

US 2013/0288503 A1 Oct. 31, 2013

(30) Foreign Application Priority Data

Apr. 26, 2012 (CN) ..... 2012 2 0181780 U

(51) Int. Cl.
*H01R 13/62* (2006.01)
*H01R 12/70* (2011.01)
*H01R 12/72* (2011.01)

(52) U.S. Cl.
CPC ..... *H01R 13/62* (2013.01); *H01R 12/707* (2013.01); *H01R 12/721* (2013.01)
USPC ..... 439/326

(58) Field of Classification Search
CPC ..... H01R 12/721
USPC ..... 439/326–328
See application file for complete search history.

(56) References Cited

U.S. PATENT DOCUMENTS

| | | | | |
|---|---|---|---|---|
| 6,939,156 | B2 * | 9/2005 | Lee | 439/328 |
| 7,048,565 | B2 * | 5/2006 | Lin | 439/326 |
| 7,074,067 | B2 * | 7/2006 | Yang et al. | 439/326 |
| 7,175,461 | B1 * | 2/2007 | Ju | 439/326 |
| 7,484,983 | B2 * | 2/2009 | Ju | 439/327 |
| 7,717,728 | B1 * | 5/2010 | Wang | 439/328 |
| 7,828,580 | B2 * | 11/2010 | Zhu et al. | 439/352 |
| 8,251,727 | B2 * | 8/2012 | Zhu | 439/327 |
| 8,251,728 | B2 * | 8/2012 | Zhu | 439/328 |
| 8,308,499 | B2 * | 11/2012 | Yeh | 439/326 |
| 8,398,422 | B2 * | 3/2013 | Zhu | 439/326 |

(Continued)

FOREIGN PATENT DOCUMENTS

| | | |
|---|---|---|
| CN | 100416938 | 9/2008 |
| TW | M276353 | 9/2005 |

(Continued)

*Primary Examiner* — Ross Gushi
(74) *Attorney, Agent, or Firm* — Wei Te Chung; Ming Chieh Chang

(57) ABSTRACT

A card edge connector includes an insulative housing, a plurality of conductive terminals and a pair of metal members attached to the insulative housing. The insulative housing defining a pair of latching arms integrally extending forwardly from opposite ends thereof and a mounting slot below said each latching arm. Each metal member including a first metal member closely and vertical attached to the latching arm and a second metal member movably received in the mounting slot. wherein the first metal member defines a stopping portion extending to the second metal member, the second metal member defines a solder portion and a stopped portion extending to the stopping portion, the stopping portion is located in front of the stopped portion in a front-to-rear direction, thereby the second metal member is prevent from forwardly departing from the mounting slot by the stopping portion of the first metal member.

20 Claims, 7 Drawing Sheets

(56) References Cited

U.S. PATENT DOCUMENTS

| | | | | |
|---|---|---|---|---|
| 8,454,380 | B2 * | 6/2013 | Zhu et al. | 439/326 |
| 8,636,534 | B2 * | 1/2014 | Zhu | 439/328 |
| 2004/0248451 | A1 * | 12/2004 | Lee | 439/328 |
| 2004/0248452 | A1 * | 12/2004 | Lee | 439/328 |
| 2005/0136724 | A1 * | 6/2005 | Lin | 439/326 |
| 2005/0164539 | A1 * | 7/2005 | Lee | 439/328 |
| 2011/0039454 | A1 * | 2/2011 | Zhu et al. | 439/680 |
| 2011/0171847 | A1 * | 7/2011 | Zhu | 439/327 |
| 2011/0287664 | A1 * | 11/2011 | Zhu et al. | 439/629 |
| 2011/0300734 | A1 * | 12/2011 | Zhu | 439/325 |
| 2013/0045619 | A1 * | 2/2013 | Zhu | 439/350 |
| 2013/0109214 | A1 * | 5/2013 | Ching | 439/328 |
| 2013/0288503 | A1 * | 10/2013 | Zhu et al. | 439/327 |
| 2013/0309892 | A1 * | 11/2013 | Chen | 439/327 |
| 2014/0080345 | A1 * | 3/2014 | Xu | 439/327 |
| 2014/0170882 | A1 * | 6/2014 | Wang | 439/328 |

FOREIGN PATENT DOCUMENTS

| | | |
|---|---|---|
| TW | I264167 | 10/2006 |
| TW | M377726 | 4/2010 |

* cited by examiner

CARD EDGE CONNECTOR WITH FLOATING METAL MEMBER

BACKGROUND OF THE INVENTION

1. Field of the Invention

The present invention relates to a card edge connector, and more particularly to a card edge connector having a pair of metal members used for being mounted on a printed circuit board.

2. Description of the Related Art

China Pat. No. 100416938C issued on Sep. 3, 2008, discloses a card edge connector including: an insulative housing, a pair of latching arms extending forwardly from the longitudinal ends of the insulative housing and a plurality of conductive terminals accommodated in the insulative housing. Each of the latching arms defines a guide portion and a locking portion to provide a guide function and a locking function during an insertion of the electrical card module, respectively. Because of insufficient strength of the latching arm, each of the latching arms also defines a metal member in order to enhance the strength of the latching arm in the outside thereof The metal member includes an elongated main body covering the latching arm, a guide plate and a strengthening plate bending inwardly from the upper edge of the main body. The guide plate and the strengthening plate are in conjunction with the guide portion and the locking portion. A solder portion bends and extends downwardly from the lower edge of the main body. It will produce a lot of heat which may cause distortion of the insulative housing due to the large number of the conductive terminals when the card edge connector is soldered to the circuit board, so that there may be a phenomenon of blank welding with the solder portion of the metal member welded.

Therefore, an improved card edge connector is desired to overcome the disadvantages of the related arts.

BRIEF SUMMARY OF THE INVENTION

An object of the present invention is to provide a card edge connector to improve welding condition of metal members.

In order to achieve above-mentioned object, a card edge connector includes an insulative housing, a plurality of conductive terminals and a pair of metal members attached to the insulative housing. The insulative housing defining a pair of latching arms integrally extending forwardly from opposite ends thereof and a mounting slot below said each latching arm. Each metal member including a first metal member closely and vertical attached to the latching arm and a second metal member movably received in the mounting slot. Wherein the first metal member defines a stopping portion extending to the second metal member, the second metal member defines a solder portion and a stopped portion extending to the stopping portion, the stopping portion is located in front of the stopped portion in a front-to-rear direction, thereby the second metal member is prevent from forwardly departing from the mounting slot by the stopping portion of the first metal member, and the welding condition of the second metal member also has a certain improvement.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
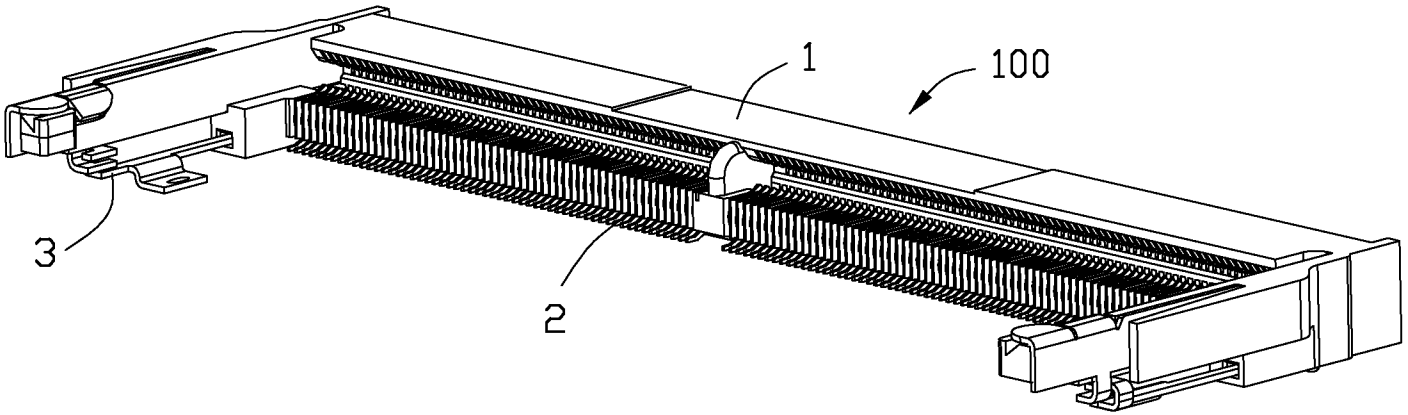
FIG. 1 is a perspective view of a card edge connector in accordance with the present invention.
Figure 2:
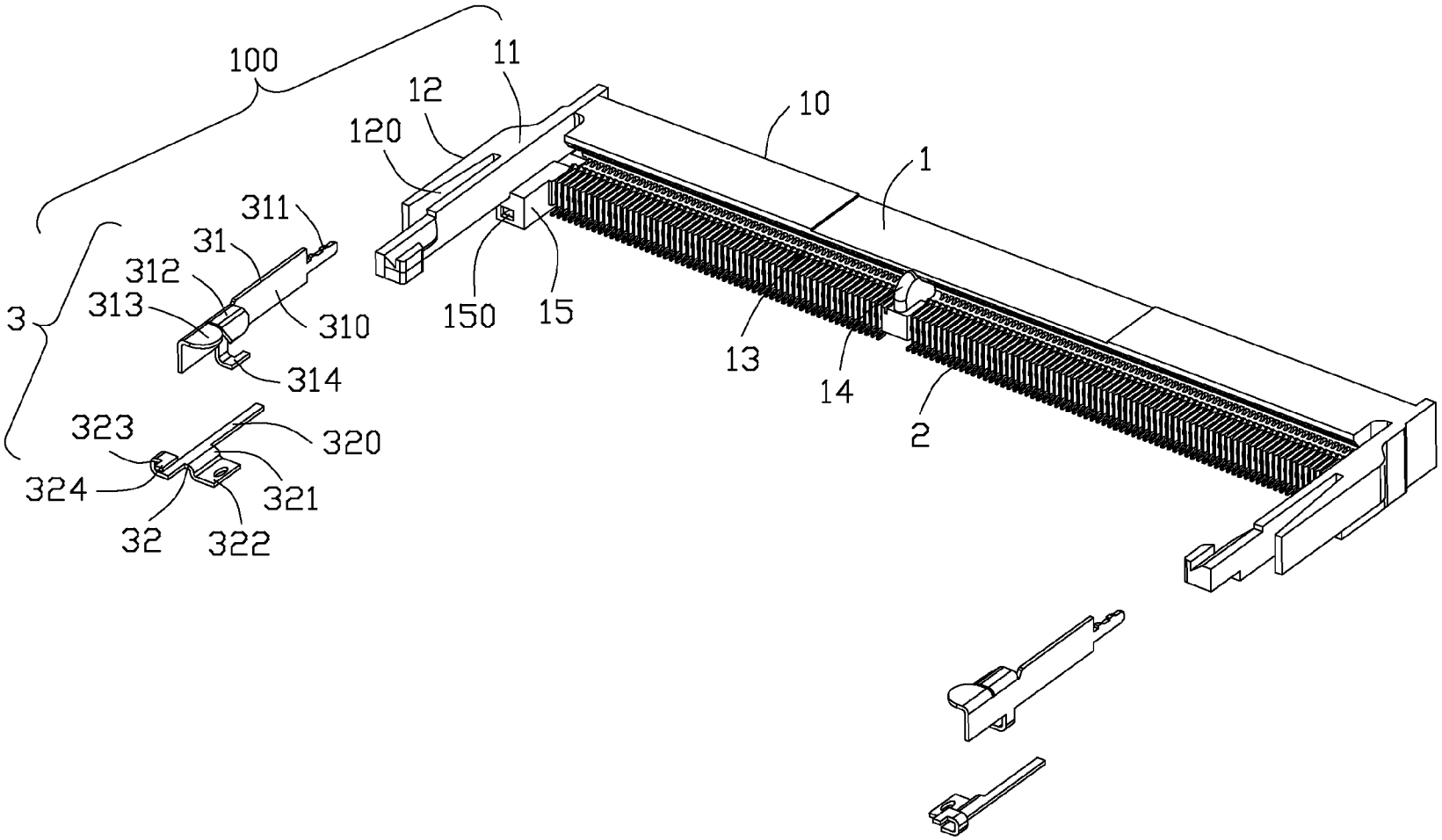
FIG. 2 is an exploded perspective view of the card edge connector shown in FIG. 1.
Figure 3:
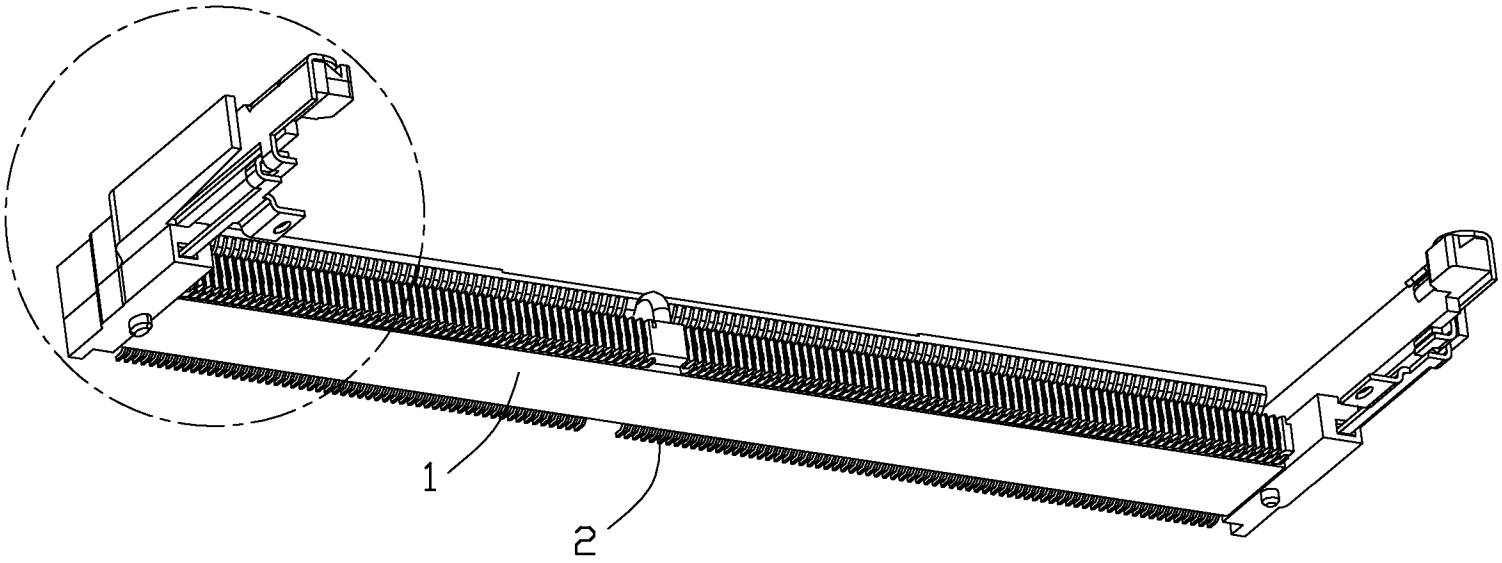
FIG. 3 is another perspective view similar to FIG. 1.
Figure 4:
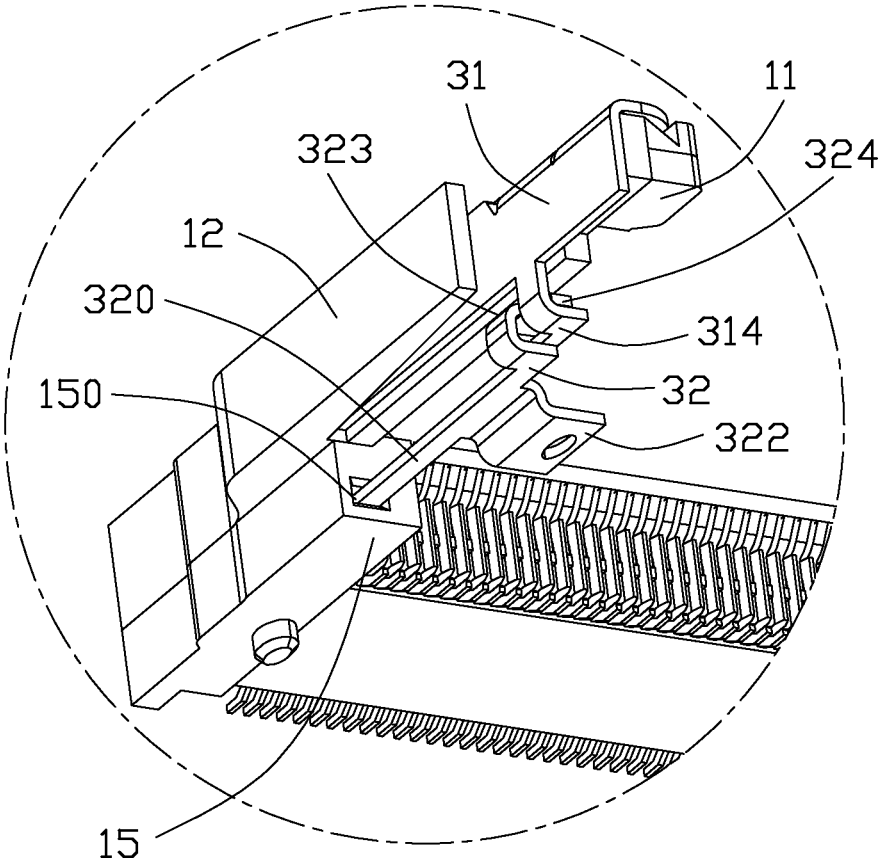
FIG. 4 is a partially enlarged view of the card edge connector of FIG. 3.
Figure 5:
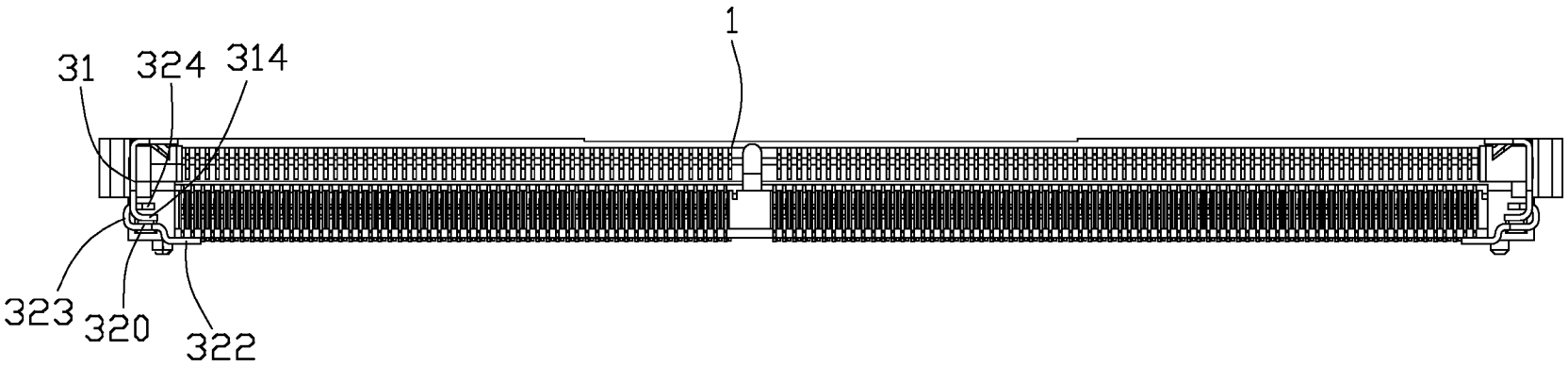
FIG. 5 is a front view of the card edge connector shown in FIG. 1.

Reference will now be made to the drawing figures to describe a preferred embodiment of the present invention in detail. Referring to FIGS. 1 to 5 illustrate a card edge connector 100 for accommodating an electrical card and soldered on a motherboard of an electrical device in order to achieve the electronic transmission between the electrical card and the motherboard. The card edge connector 100 including an insulative housing 1, a plurality of conductive terminals 2 accommodated in the insulative housing 1 and a pair of metal members or fastening devices 3 mounted on the opposite ends of the insulative housing 1. It should be noted that the card edge connector of the present invention is a low profile card edge connector, such as a height of 4.0 mm, 2.5 mm, and so on. High profile card edge connectors have enough space to set metal members, while the low profile card edge connector is greater difficulty to set metal members due to space limitations.

The insulative housing 1 is injection molding by a kind of insulative material, such as plastic, etc., and comprises a rectangular base portion 10 and a pair of latching arms 11 located on the opposite ends of the base portion 10 for retaining the electrical card. The latching arm 11 defines a blocking arm 12 at the outside of the latching arm to prevent outward movements of the latching arms 11 excessively, and a space 120 is formed between the latching arm 11 and the blocking arm 12. A mounting portion 15 is formed below the latching arm 12 at each of opposite ends of the base portion 10, wherein length of the mounting portion 15 is less than length of the latching arms 11 in a front-to-rear direction so that a receiving space is formed below the latching arm 12 for accommodating the metal member 3. The mounting portion 15 defines a mounting slot 150 opening forwards. The base portion 10 defines a central slot 13 extending along a longitudinal direction of the housing perpendicular to the front-to-rear direction, a key 14 is disposed in the central slot 13 and closes to one of the latching arms 11 for preventing a mistaken insertion of the electrical card. The plurality of conductive terminals 2 are located at the upper and lower sides of the central slot 13, wherein the conductive terminals 2 at upper side are inserted into the base portion 10 in the front and rear direction from a rear face of the base portion while the conductive terminals 2 at lower side are inserted into the base portion 10 from the rear face of the base portion.

Each metal member 3 comprises a first metal member 31 and a second metal member 32 discrete from each other. The first metal member 31 defines a vertical plated-shaped first main portion or arm 310, a retaining portion 311 extending rearwardly from a rear end of the first main portion 310, a fool-pool portion 313 and a guide portion 312 bending inwardly from an upper side of the front end of the first main portion 310 respectively, and a stopping portion 314 extending downwardly and bending inwardly and then extending rearwardly from the lower side of the first main portion 310. The stopping portion 314 is in a hooked shape and projecting from the lower surface of the latching arm 11 when the first metal member 31 is attached to the latching arm 11. The first metal members 31 are attached on outers of the latching arms 11 in order to increase the strength of the latching arms 11, wherein the retaining portions 311 are inserted into and retained in the insulative housing 1 through the spaces 120.

The second metal member 32 comprises a horizontal and elongated second main portion or arm 320, an extension portion 321 extending downwardly from an inner edge of the second main portion 320, a solder portion 322 bending and extending from the extension portion 321, and a locking portion 323 bending and extending from the front of the outer edge of the second main portion 320. A stopped portion 324 projects forwardly from a front of the locking portion 323. The second metal member 32 is a flat-shaped structure so that it will occupy a smaller space to be mounted into the insulative housing 1. The other end of the second main portion 320 opposite to the locking portion 323 is treated as a mounting end of the second metal member 32. Alternatively, the mounting end can also be formed from other parts of the second main portion 320, such as the intermediate portion.

An assembling process of the metal members 3 are given as follows. Firstly, the second main portions 320 of the second metal members 32 are inserted into the mounting slots 150. There is a certain gap between the second main portion 320 and the mounting slot 150 so that the second metal members 32 can be active within a certain range in the mounting slots so as to benefit welding conditions of the second metal members 32. Secondly, the first metal members 31 are attached to the latching arms 11, the stopping portions 314 of the first metal members 31 are located in the front of the locking portions 323 and partly projecting into the locking portion 323 so that the stopping portions 314 are located at the inner side of the locking portions 323. Thus, the second metal members 32 are stopping forward movement to avoid departing from the mounting slots 150 even though the second metal members 32 are actively received in the mounting slots 150 without any or little interference force with the mounting slots. In addition, the stopped portions 324 of the second metal member 32 are also located in the inside of the tops of the stopping portions 314 of the first metal members 31, the stopped portions 324 can prevent the excessive inward movement of the latching arms 11 by abutting the stopping portions 314 when the latching arms 11 move inwardly by external forces. Because of the compact engagement between the first metal members 31 and the second metal members 32, it is not only solved the problem of welding and can adapt to the lower profile card edge connector in the present invention.

Figure 6:
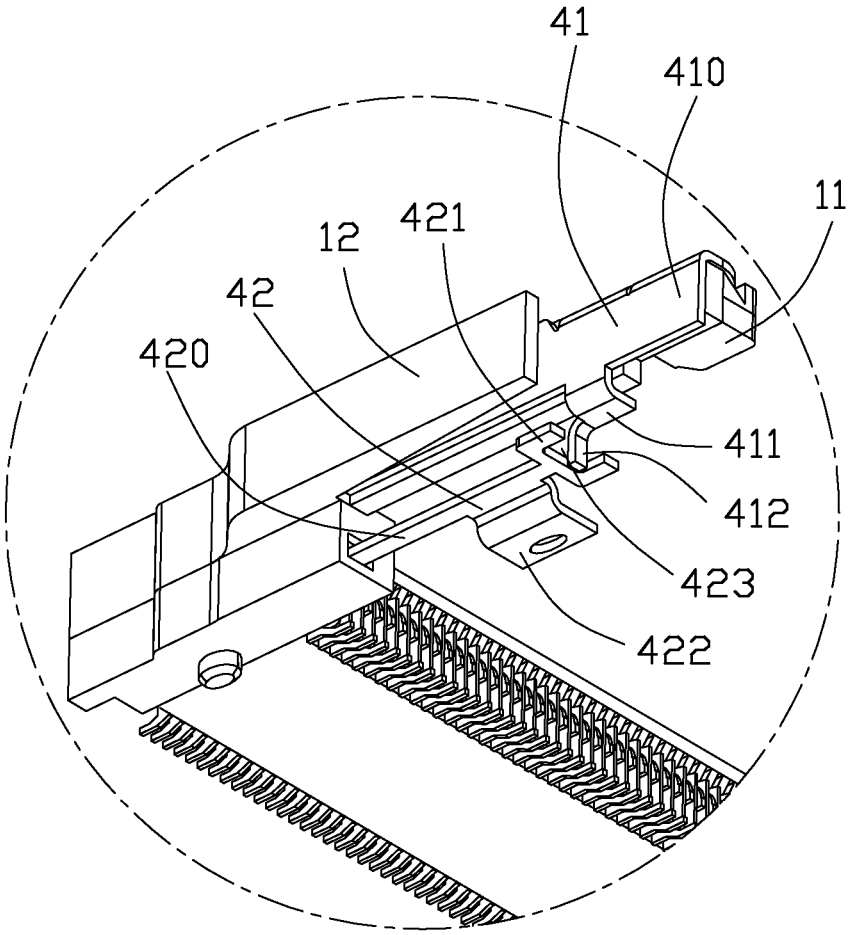
FIG. 6 is a partially enlarged view of a card edge connector in the second embodiment.

FIG. 6 is a partially enlarged view of a card edge connector in the second embodiment, wherein other portions expect the metal members are same to the first embodiment and omitted. Each first metal member 41 includes a vertical plated-shaped first main portion 410, a bending portion 411 extending and bending from a lower edge of the first main portion 410, and a stopping portion 412 bending vertically from the bending portion 411. Each second metal member 42 comprises a horizontal and elongated second main portion 420, a solder portion 422 bending and extending from an inner edge of the second main portion 420, and a forked-shaped locking portion 421 facing forwards from the front edge of the second main portion 420. An opening 423 is formed in the middle of the forked-shaped locking portion 421 and receiving the stopping portion 412 of the first metal member 41, which can not only prevent the second metal member 42 departing from the insulative housing 1 and can protect the latching arm 11 from excessive moving around to be broken. The second metal member 42 is flat-shaped structure, in particular, the distance between the second main portion 420 and the solder portion 422 is limited, which is exactly adapt to the lower profile card edge connector in the present invention. Further, the second metal members 42 can be active within a certain range so that the welding condition of the second metal members 42 also has a certain improvement.

Figure 7:
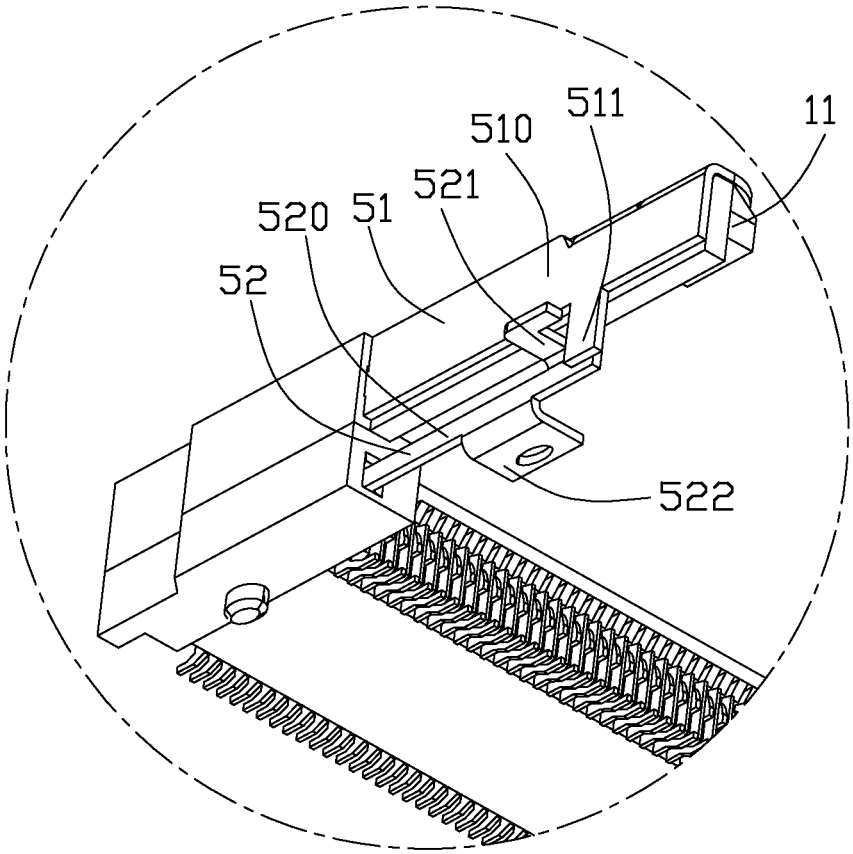
FIG. 7 is a partially enlarged view of a card edge connector in the third embodiment.

FIG. 7 is a partially enlarged view of a card edge connector in the third embodiment, wherein other portions expect the metal members are same to the first embodiment and omitted, each first metal member 51 includes a plated-shaped first main portion 510, a stopping portion 511 extending downwardly and vertically from the first main portion 510. It is noted that, in the present embodiment, there is no blocking arm at outer sides of the latching arms 11. Each second metal member 52 is Z-shaped and defines a vertical plated-shaped and elongated second main portion 520, a solder portion 522 bending vertically from a lower edge of the second main portion 520, and a locking portion 521 bending vertically from the front of the other edge of the second main portion 520. The locking portion 521 is L-shaped and located at the rear side and the outside of the stopping portion 511 of the first metal member 51, so that the second metal member 52 in the activity is not departed from the insulative housing by the limitation of the stopping portion 511, and the amplitude of the movement outward of the first metal member 51 will be limited by the locking portion 521 to prevent the latching arm 11 from excessive movement outward. The more important is that the total height of the second metal member 52 is only the height of the second main portion 520 in the vertical direction, and the second metal member 52 is a flat-shaped structure to exactly adapt to the lower profile card edge connector. The second metal member 52 can be active within a certain range, and the welding condition of the second metal member 52 also has a certain improvement.

Above the several embodiments in present invention, the second main portions of the second metal members are elongated shaped, which means that the shape of the second main portion determines the overall shape of the second metal member to be a flat-shaped, and it is meet the space requirement of the card edge connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, comprising:

an insulative housing defining a base portion, a pair of latching arms integrally extending forwardly from opposite ends of the base portion and a mounting portion below each latching arm, the base portion defining a central slot extending perpendicular to the latching arms;

a plurality of conductive terminals received in the insulative housing with contacting portions exposing to the central slot;

a pair of metal members attached to the insulative housing, each metal member including a first metal member closely attached to the latching arm and a second metal member movably received in the mounting slot at one end of the second metal member; wherein the first metal member defines a stopping portion extending to the second metal member, the second metal member defines a second main portion, a solder portion and a stopped portion, the stopped portion of the second metal member is located behind the stopping portion of the first metal member in a front-to-rear direction, thereby the second metal member is prevent from forwardly departing from the mounting slot by the stopping portion of the first metal member.

2. The card edge connector as described in claim 1, wherein the stopped portion of the second metal member has a first portion located at inside of the stopping portion of the first metal member and has a second portion located at outside of the stopping portion, thereby the stopped portion of the second metal member is limited in a movement perpendicular to the latching arm.

3. The card edge connector as described in claim 1, wherein the mounting portion defines a mounting slot, in which an opposite end of the second main portion of the second metal member to the locking portion without any barbs is accommodated movably.

4. The card edge connector as described in claim 1, wherein the first metal member are disposed vertically and the locking portions are disposed horizontally, the stopped portions are disposed horizontally.

5. The card edge connector as described in claim 4, wherein the stopped portions are disposed in an inverted U shape and the stopping portions extend into the U shaped, the U shapes extend a front tab located inside of the stopping portion.

6. The card edge connector as described in claim 1, wherein the first metal members and the stopping portions are disposed vertically, the stopped portions of the second metal members are disposed horizontally, the stopped portion are shaped in a fork portion with an opening in which the stopping portions extend.

7. The card edge connector as described in claim 6, wherein the second metal members are disposed horizontally.

8. The card edge connector as described in claim 7, wherein the second metal members are disposed in vertically, the stopping portions are located between the stopped portions and the main portion of the second metal member.

9. A card edge connector, comprising:

an insulative housing defining a pair of latching arms integrally extending forwardly from opposite ends thereof and a mounting slot below said each latching arm;

a plurality of conductive terminals received in the insulative housing;

a pair of metal members attached to the insulative housing, each metal member including a first metal member closely and vertical attached to the latching arm and a second metal member movably received in the mounting slot; wherein the first metal member defines a stopping portion extending to the second metal member, the second metal member defines a solder portion and a stopped portion extending to the stopping portion, the stopping portion is located in front of the stopped portion in a front-to-rear direction, thereby the second metal member is prevent from forwardly departing from the mounting slot by the stopping portion of the first metal member.

10. A card edge connector comprising:

an elongated insulative housing defining a central slot extending along a longitudinal direction and communicating with an exterior in a front-to-back direction perpendicular to said longitudinal direction, and a pair of mounting slots respectively located at two opposite ends of the housing in said longitudinal direction, each of said mounting slots extending in said front-to-back direction;

a plurality of contacts disposed in the housing beside said central slot; and a pair of fastening devices assembled to two opposite ends of the housing in said longitudinal direction, each of said fastening devices including an upper first metal member and a lower second metal member discrete from each other, the first metal member fixed to the housing with a first arm adapted to be deflectable along the longitudinal direction, a stopping portion formed away from a root portion of the arm, the second metal member defining a second arm loosely received within the corresponding mounting slot, and a solder portion located around a bottom face of the housing for adjustably soldering to a printed circuit board; wherein the second metal member includes a stopped portion forwardly and intimately confronting the stopping portion so as to have the second metal member not dropped from the housing before the connector is mounted to the printed circuit board.

11. The card edge connector as claimed in claim 10, wherein said stopping portion defines a horizontal edge forwardly confronting the stopping portion.

12. The card edge connector as claimed in claim 11, wherein said stopping portion defines a vertical edge rearwardly confronting said horizontal edge.

13. The card edge connector as claimed in claim 10, wherein said second metal member further defines means for restraining movement of the first member in said longitudinal direction.

14. The card edge connector as claimed in claim 13, wherein said means is located around the stopped portion.

15. The card edge connector as claimed in claim 14, wherein said means defines a U-shaped configuration.

16. The card edge connector as claimed in claim 15, wherein said U-shaped configuration extends in a horizontal plane.

17. The card edge connector as claimed in claim 15, wherein said U-shaped configuration lies horizontally while extending in said front-to-back direction.

18. The card edge connector as claimed in claim 14, wherein means defines an L-shaped configuration.

19. The card edge connector as claimed in claim 10, wherein said housing further unitarily includes a pair of latching arms to which the corresponding first metal members are associated.

20. The card edge connector as claimed in claim 10, wherein said stopping portion and said stopped portion are essentially in a same position in said front-to-back direction while said solder portion is located spaced from said same position in said front-to-back direction.

* * * * *